US010000826B2

(12) United States Patent
Kosaka

(10) Patent No.: US 10,000,826 B2
(45) Date of Patent: Jun. 19, 2018

(54) ALPHA-BETA TITANIUM ALLOY HAVING IMPROVED ELEVATED TEMPERATURE PROPERTIES AND SUPERPLASTICITY

(71) Applicant: Titanium Metals Corporation, Exton, PA (US)

(72) Inventor: Yoji Kosaka, Henderson, NV (US)

(73) Assignee: Titanium Metals Corporation, Exton, PA (US)

( * ) Notice: Subject to any disclaimer, the term of this patent is extended or adjusted under 35 U.S.C. 154(b) by 174 days.

(21) Appl. No.: 15/066,193

(22) Filed: Mar. 10, 2016

(65) Prior Publication Data

US 2017/0260607 A1 Sep. 14, 2017

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00
See application file for complete search history.

(56) References Cited

U.S. PATENT DOCUMENTS

| | | | |
|---|---|---|---|
| 6,786,985 | B2 | 9/2004 | Kosaka et al. |
| 7,767,040 | B2 | 8/2010 | Kosaka et al. |
| 8,551,264 | B2 | 10/2013 | Kosaka et al. |
| 2003/0211003 | A1 | 11/2003 | Kosaka et al. |

OTHER PUBLICATIONS

ASM Materials Properties Handbook Evolution of Conventional High-Temp Ti Alloys; p. 77 (Jun. 1994).
ISRWO of PCT/US2017/021788 dated May 26, 2017.

*Primary Examiner* — Matthew E Hoban
(74) *Attorney, Agent, or Firm* — Burris Law, PLLC

(57) ABSTRACT

A high strength alpha-beta alloy is provided that has improved high temperature oxidation resistance, high temperature strength and creep resistance, and improved superplasticity. In one form, the alloy comprises about 4.5 wt % to about 5.5 wt % aluminum, about 3.0 wt % to about 5.0 wt % vanadium, about 0.3 wt % to about 1.8 wt % molybdenum, about 0.2 wt % to about 1.2 wt % iron, about 0.12 wt % to about 0.25 wt % oxygen, about 0.10 wt % to about 0.40 wt % silicon, with the balance titanium and incidental impurities, with each being less than about 0.1 wt % and about 0.5 wt %, respectively, in total.

21 Claims, 3 Drawing Sheets

Comparison of weight gain after oxidation tests in air

Creep curves of H12613 (Comparative) and V8124 (Inventive) alloys tested at 427°C (800°F) with 241MPa (35 ksi)

ALPHA-BETA TITANIUM ALLOY HAVING IMPROVED ELEVATED TEMPERATURE PROPERTIES AND SUPERPLASTICITY

FIELD

This disclosure relates generally to titanium alloys. More specifically, this disclosure relates to titanium alloys having a combination of properties including high temperature oxidation resistance, high temperature strength and creep resistance, along with superplasticity.

BACKGROUND

The statements in this section merely provide background information related to the present disclosure and may not constitute prior art.

Titanium alloys are commonly used in applications such as aerospace due to their excellent strength-to-weight ratios and high temperature capability. One known titanium alloy is Ti-54M ("TIMETAL® 54M"), which has high strength, good machinability, and excellent ballistic properties, especially versus that of Ti-64.

One process that has been used to form parts from titanium alloys is superplastic forming. In this process, the titanium alloy is deformed at elevated temperatures to cause the material to flow a relatively large amount without rupturing. The ability of titanium alloys to flow under such manufacturing conditions is a property called superplasticity.

Both Ti-54M and Ti-64 alloys exhibit superplasticity, while the Ti-54M alloy exhibits superplasticity at lower temperatures, as compared with Ti-64, the latter of which is the most common titanium alloy used in superplastic forming applications. For example, Ti-54M sheets, processed through a rolling process disclosed in U.S. Pat. No. 8,551,264, (which is commonly owned with the present application and the contents of which are incorporated herein by reference in their entirety), exhibit superplasticity at temperatures as low as 775° C. (1427° F.), which is more than 100° C. lower than the temperatures used for Ti-64. Although Ti-54M shows excellent superplasticity at lower temperatures, this alloy does not display significant advantages over competitive alloys in higher temperature strength, creep resistance or oxidation resistance, which are often desired for high temperature applications.

SUMMARY

The present disclosure generally relates to a high strength alpha-beta alloy with improved high temperature oxidation resistance, high temperature strength and creep resistance, and improved superplasticity. In one form, the alloy comprises about 4.5 wt % to about 5.5 wt % aluminum, about 3.0 wt % to about 5.0 wt % vanadium, about 0.3 wt % to about 1.8 wt % molybdenum, about 0.2 wt % to about 1.2 wt % iron, about 0.12 wt % to about 0.25 wt % oxygen, about 0.10 wt % to about 0.40 wt % silicon, with the balance titanium and incidental impurities, with each of the impurities being less than about 0.1 wt % each and about 0.5 wt %, in total.

In another form the amount of silicon is in a range of about 0.15 wt % to about 0.40 wt %, and in another form the silicon content is between about 0.25 wt % and about 0.35 wt %.

Methods of melting the alloys and forming sheets are also provided, along with parts formed using the inventive alloys of the present disclosure. For example, the inventive alloys can be melted with a multiple VAR (Vacuum Arc Remelting) process or cold hearth melting, or a combination thereof. The cold hearth melting can include either an electron beam or a plasma arc as a power source for melting the titanium alloys. The melted and cast ingots can be forged or rolled to slabs through a hot working process, then hot-rolled to intermediate plates. The plates can then be hot rolled to sheets, followed by heat treatment. The sheets may also be ground to remove scale and alpha case on their surfaces.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
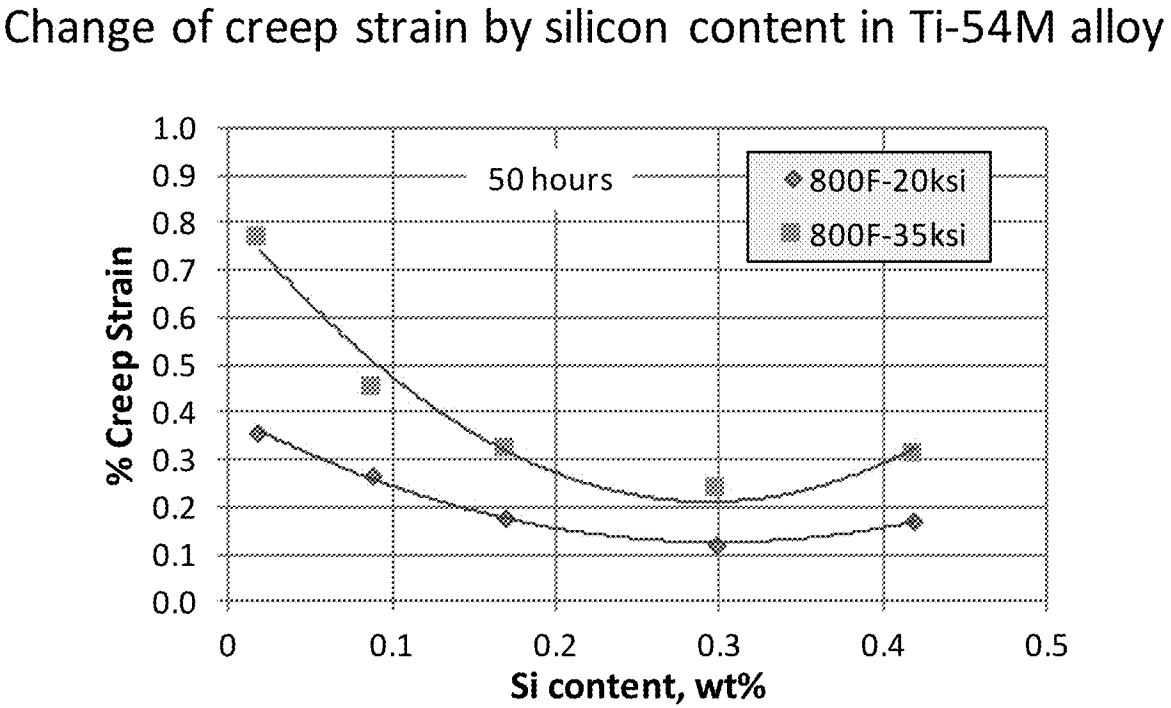
FIG. 1 is a graph illustrating the effect of silicon (Si) content on the creep properties of a prior art Ti-54M alloy.

The following description is merely exemplary in nature and is in no way intended to limit the present disclosure or its application or uses. It should be understood that throughout the description, corresponding reference numerals indicate like or corresponding parts and features.

The present disclosure includes an alpha-beta titanium alloy comprising about 4.5 wt % to about 5.5 wt % aluminum, about 3.0 wt % to about 5.0 wt % vanadium, about 0.3 wt % to about 1.8 wt % molybdenum, about 0.2 wt % to about 1.2 wt % iron, about 0.12 wt % to about 0.25 wt % oxygen, about 0.10 wt % to about 0.40 wt % silicon, with the balance titanium and incidental impurities, with each being less than about 0.1 wt % and about 0.5 wt %, respectively, in total.

Optional alloying elements may include niobium (Nb), chromium (Cr), tin (Sn), and/or zirconium (Zr), which are less than about 1.0 wt % in total.

Each of the alloying elements and their criticality in achieving the desired properties and superplasticity is now described in greater detail:

Aluminum

The alloy of the present disclosure contains aluminum (Al) as an alpha stabilizer and also for strength and microstructural control. Microstructural control is desired for proper fabrication/manufacturing because the microstructure is closely related to process parameters such as temperature, strain rate, strain, and their interactions. When the aluminum content is less than 4.5 wt %, the effect of solution hardening is less pronounced, therefore the desired strength cannot be achieved. When the aluminum content exceeds 5.5 wt %, the beta transus temperature becomes too high and resistance to hot formability is increased, thereby decreasing the ability to achieve lower temperature superplasticity. Accordingly, the aluminum content of the present disclosure is in the range of about 4.5 to about 5.5 wt % to provide high strength and lower temperature superplasticity. The "lower temperature" superplasticity as referred to herein is specifically defined as having sufficient superplasticity, while maintaining the mechanical properties desired, at temperatures below about 815° C. (1,500° F.). Further, "excellent" superplasticity provided by the inventive alloys disclosed herein is referred to as having elongation greater than about 1000%.

Vanadium

Vanadium (V) is a beta stabilizer and is used to achieve the desired strength of the inventive alloys disclosed herein. Similar to Aluminum, vanadium is also used to achieve the desired microstructure for lower temperature superplasticity. If the vanadium content is less than 3.0 wt %, sufficient strength will not be obtained and a desired volume fraction of alpha-beta phase that is desired for superplasticity will not be obtained at lower temperatures. If the vanadium content is higher than 5.0 wt %, oxidation resistance is degraded, and higher vanadium content increases density and cost, which is undesirable. And with higher vanadium content, the beta phase may be excessively stabilized. In this case, a microstructure may result that is not conducive to superplastic forming temperatures. Therefore, the vanadium content of the present disclosure is in the range of about 3.0 wt % to about 5.0 wt % to provide high strength and lower temperature superplasticity.

Molybdenum

Molybdenum (Mo) is a beta stabilizing element and is effective for grain refinements, which is desirable for superplasticity. If the molybdenum content is lower than 0.3 wt %, sufficient superplasticity at lower temperatures will not be obtained. On the other hand, if the molybdenum content is higher than 1.8 wt %, the beta phase will may excessively stabilized, thus resulting in a microstructure that may not conducive to superplastic forming temperatures. Higher amounts of molybdenum will also increase density above a target value of less than about 4.60 g/cm$^3$. Accordingly, it was determined that the molybdenum content for the present disclosure is in the range of about 0.3 wt % to about 1.8 wt %.

Iron

Iron (Fe) is provided in the inventive alloys because it acts as a strong eutectoid beta stabilizer and its diffusion coefficient is much higher than other elements such as molybdenum or vanadium. Accordingly, iron is an effective element for superplasticity because it can promote grain boundary sliding due to its extremely fast diffusivity, which is desirable for lower temperature superplasticity. If the iron content is less than about 0.2 wt %, sufficient low temperature superplasticity cannot be obtained. If the iron content exceeds about 1.2 wt %, a risk of segregation exists, which may cause beta fleck, a microstructural defect, in the end products. Therefore, the iron content of the present disclosure is in the range of about 0.2 wt % to about 1.2 wt %.

Oxygen

Oxygen (O) is an interstitial element and an alpha stabilizing element, similar to aluminum. Additionally, Oxygen is one of the most effective elements for strengthening titanium alloys. A small amount of oxygen strengthens titanium, however, an excessive amount of oxygen will cause brittleness. Therefore, the range of oxygen according to the present disclosure is in the range of about 0.12 wt % to about 0.25 wt %.

Silicon

Silicon (Si) is an element that is used for oxidation resistance, and titanium alloys for high temperature applications often contain less than about 0.5 wt % silicon to increase elevated temperature strength and creep resistance. Silicon improves high temperature strength by solid solution strengthening and/or precipitation hardening by forming fine titanium silicide particles. If the silicon content is lower than about 0.15 wt %, sufficient strength and creep resistance may not be obtained. An excessive amount of silicon may result in adverse effects on formability by forming coarse silicides. Therefore, the inventor hereof has discovered that a synergistic effect is obtained when the silicon content is in a range of about 0.10 wt % to about 0.40 wt % of the inventive alloy.

The following specific alloys are given to illustrate the composition, properties, and use of titanium alloys prepared according to the teachings of the present disclosure and should not be construed to limit the scope of the disclosure. Those skilled in the art, in light of the present disclosure, will appreciate that slight changes can be made in the specific alloys to achieve equivalents that obtain alike or similar results without departing from or exceeding the spirit or scope of the present disclosure.

Mechanical property testing was performed and compared for titanium alloys prepared within the claimed compositional range, prepared outside of the claimed compositional range, and on conventional alloys either currently in use or potentially suitable for use. One skilled in the art will understand that any properties reported herein represent properties that are routinely measured and can be obtained by multiple different methods. The methods described herein represent one such method and other methods may be utilized without exceeding the scope of the present disclosure.

EXAMPLE 1

Five (5) laboratory ingots, two (2) with alloys according to the present disclosure and three (3) comparative alloy compositions, were double melted to a 200 mm final diameter (16 kg each) as shown below in Table 1:

TABLE 1

Chemical Compositions of Experimental Alloys

| | Chemical Composition (wt %) | | | | | | |
|---|---|---|---|---|---|---|---|
| Heat # | Al | V | Mo | Fe | O | Si | Remarks |
| V8496 | 5.04 | 4.00 | 0.74 | 0.49 | 0.18 | 0.024 | Comparative |
| V8497 | 4.77 | 3.89 | 0.74 | 0.49 | 0.16 | 0.089 | Comparative |
| V8498 | 4.75 | 3.90 | 0.75 | 0.49 | 0.17 | 0.165 | Inventive |
| V8499 | 4.68 | 3.82 | 0.72 | 0.48 | 0.16 | 0.301 | Inventive |
| V8500 | 4.68 | 3.76 | 0.72 | 0.49 | 0.17 | 0.422 | Comparative |

It is noted that the Heat# V8496 is an alloy with a typical Ti-54M composition. The ingots were heated at 1149° C. (2100° F.) and breakdown forged to 127 mm (5") square (SQ) billets. The billets were then converted to sheets using the following processes:

1) Heat at 913° C. (1675° F.) then forge to 44 mm×152 mm (1.75"×6") slab;

2) Heat at 913° C. (1675° F.) and hot roll to 19 mm (0.75") thick plate;

3) Heat at 1066° C. (1950° F.) for 20 minutes followed by water quench;

4) Heat at 760° C. (1400° F.) and roll to 4.3 mm (0.17") thick;

5) Heat at 760° C. (1400° F.) and continue rolling to 2.0 mm (0.080");

6) Mill anneal at 788° C. (1450° F.); and

7) Grind down to 1.3 mm (0.050").

Room temperature tensile tests were conducted in longitudinal and transverse directions from all the above Heats using ASTM E8 sub-size specimens. The results from the tensile tests are shown below in Table 2:

TABLE 2

Room Temperature Tensile Properties of Experimental Alloy Sheets

| Heat # | Si wt % | Direction | YS MPa | YS ksi | UTS MPa | UTS ksi | Elongation % | Modulus msi | Remarks |
|---|---|---|---|---|---|---|---|---|---|
| V8496 | 0.024 | L | 845 | 122.5 | 889 | 128.9 | 20.0 | 13.6 | Comparative |
| | | T | 879 | 127.5 | 894 | 129.6 | 16.9 | 15.5 | |
| V8497 | 0.089 | L | 855 | 124.0 | 898 | 130.3 | 13.9 | 14.6 | Comparative |
| | | T | 827 | 120.0 | 880 | 127.7 | 17.7 | 14.0 | |
| V8498 | 0.165 | L | 910 | 132.0 | 915 | 132.7 | 16.0 | 15.6 | Inventive |
| | | T | 877 | 127.2 | 920 | 133.4 | 17.8 | 14.7 | |
| V8499 | 0.301 | L | 892 | 129.4 | 919 | 133.3 | 13.0 | 15.5 | Inventive |
| | | T | 872 | 126.5 | 925 | 134.2 | 13.5 | 14.8 | |
| V8500 | 0.422 | L | 938 | 136.0 | 957 | 138.8 | 10.1 | 14.6 | Comparative |
| | | T | 903 | 130.9 | 954 | 138.3 | 13.4 | 14.6 | |

A general trend, as can be seen in Table 2, shows that the strength (YS or UTS) increases and % elongation decreases with the increase in silicon content of Ti-54M. It should be noted that as the silicon content increases to 0.422 wt %, strength is considerably increased thereby sacrificing the ductility (elongation) in the material.

Creep tests were also conducted on all five (5) heats. The tests were conducted in air at 427° C. (800° F.) and in accordance with ASTM E139. All creep tests performed were continued for a sufficiently long duration to record considerable steady state deformation, which is desirable for the determination of a steady state creep rate. Results of the creep test at 427° C. (800° F.) with 138 MPa (20 ksi) of stress are shown below in Table 3:

TABLE 3

Creep Test Results of Experimental Alloys
Test temperature: 427° C. (800° F.) Test Stress: 138 MPa (20 ksi)

| Alloy | Si (wt %) | Time (hr) at % creep strain 0.10% | 0.20% | % Creep Strain at Time 25 hr | 35 hr | 50 hr | 100 hr | Creep Rate %/hr | Remarks |
|---|---|---|---|---|---|---|---|---|---|
| V8496 | 0.02 | 1.32 | 8.3 | 0.285 | 0.318 | 0.354 | 0.448 | 0.00140 | Comparative |
| V8497 | 0.09 | 1.77 | 15.8 | 0.223 | 0.242 | 0.264 | 0.318 | 0.00086 | Comparative |
| V8498 | 0.17 | 5.68 | 91.9 | 0.151 | 0.165 | 0.174 | 0.202 | 0.00038 | Inventive |
| V8499 | 0.30 | 20.7 | 615 | 0.103 | 0.114 | 0.121 | 0.14 | 0.00033 | Inventive |
| V8500 | 0.42 | 7.53 | 91.2 | 0.143 | 0.159 | 0.171 | 0.204 | 0.00056 | Comparative |

As shown, time to reach 0.10% or 0.20% of creep strain, creep strains at 25 hrs, 35 hrs, 50hrs and 100 hrs of creep test, and creep rates at steady state were captured for the five (5) alloys. It is evident from the results that creep strain at a given time decreases with increase in the content of silicon up to about 0.3 wt %, then increases when Si content is 0.42 wt %. This trend can be seen at any time and also with creep rate in addition to creep strain.

Additional creep tests were conducted at 427° C. (800° F.) with 241 MPa (35 ksi) of stress, and the results are shown below in Table 4:

TABLE 4

Creep Results of Experimental Alloys
Test temperature: 427° C. (800° F.) Test Stress: 241 MPa (35 ksi)

| Alloy | Si (wt %) | Time (hr) at % creep strain 0.10% | 0.20% | % Creep Strain at Time 25 hr | 35 hr | 50 hr | 100 hr | Creep Rate %/hr | Remarks |
|---|---|---|---|---|---|---|---|---|---|
| V8496 | 0.02 | 0.51 | 2.13 | 0.581 | 0.663 | 0.766 | 1.04 | 0.00478 | Comparative |
| V8497 | 0.09 | 0.86 | 4.25 | 0.37 | 0.408 | 0.455 | 0.56 | 0.00165 | Comparative |

TABLE 4-continued

Creep Results of Experimental Alloys
Test temperature: 427° C. (800° F.) Test Stress: 241 MPa (35 ksi)

| Alloy | Si (wt %) | Time (hr) at % creep strain 0.10% | 0.20% | % Creep Strain at Time 25 hr | 35 hr | 50 hr | 100 hr | Creep Rate %/hr | Remarks |
|---|---|---|---|---|---|---|---|---|---|
| V8498 | 0.17 | 1.69 | 8.93 | 0.269 | 0.294 | 0.323 | 0.37 | 0.00066 | Inventive |
| V8499 | 0.30 | 3.1 | 23 | 0.203 | 0.221 | 0.237 | 0.274 | 0.00053 | Inventive |
| V8500 | 0.42 | 2.2 | 11.6 | 0.256 | 0.282 | 0.313 | 0.372 | 0.00085 | Comparative |

Time to reach 0.10% or 0.20% of creep strain, creep strains at 25 hrs, 35 hrs, 50 hrs and 100 hrs of creep test and creep rates at steady state are shown for all five (5) alloys. As with the previous creep tests shown in Table 3, creep strain at a given time decreases with an increase in the content of silicon up to about 0.3 wt %, then increases when the Si content is 0.42 wt %. In one form, excellent creep resistance was obtained by the V8499 alloy, in which the Si content is 0.30 wt %.

Referring now to FIG. 1, the effect of silicon content on the creep properties of a Ti-54M alloy are shown, where creep strain at 50 hours is given for both 138 MPa (20 ksi) and 241 MPa (35 ksi) of stress. In either condition, creep strain becomes significantly reduced when the silicon content is approximately 0.3 wt %.

Oxidation tests for each of the five (5) alloys were also carried out at 1200° F. (649° C.) and 1400° F. (760° C.) for 200hrs in an air furnace. Weight gain after these oxidation tests was measured and the results are shown in Table 5:

TABLE 5

Weight Gain After Oxidation Tests for 200 Hours in Air

| Heat # | Si (wt %) | weight gain, mg/cm$^2$ 1200° F. (649° C.) | 1400° F. (760° C.) | Remarks |
|---|---|---|---|---|
| V8496 | 0.02 | 2.07 | 12.28 | Comparative |
| V8497 | 0.09 | 1.35 | 6.78 | Comparative |
| V8498 | 0.17 | 1.04 | 4.08 | Inventive |
| V8499 | 0.30 | 0.88 | 3.35 | Inventive |
| V8500 | 0.42 | 1.03 | 3.35 | Comparative |

Figure 2:
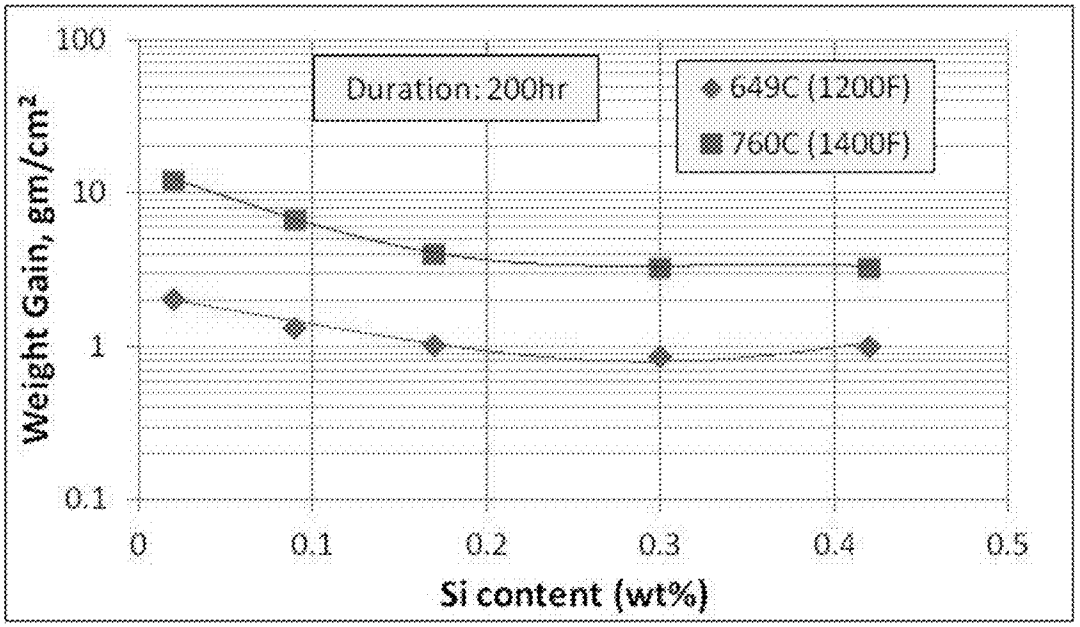
FIG. 2 is a graph illustrating a decrease in weight gain after oxidation with increased silicon (Si) content of a prior art Ti-54M alloy.

Referring to FIG. 2, results from the oxidation tests are shown in graphical form. As shown, weight gain due to oxidation decreases with an increase in Si content at both temperatures. Further, the presence of silicon significantly improves the oxidation resistance of a Ti-54M base alloy. It can also be observed that the addition of 0.30 wt % silicon to a Ti-54M base alloy appears to be a desirable condition at both oxidation temperatures, beyond which weight gain either increases (1200° F.) or remains the same (1400° F.) without any significant improvement.

EXAMPLE 2

In this experiment, two (2) alloys were prepared, one according to the present disclosure, and one comparative alloy as shown below in Table 1:

TABLE 6

Composition of Inventive Alloy V8124 and Comparative Alloy H12613

| Heat # | Al | V | Mo | Fe | Si | O | Remarks |
|---|---|---|---|---|---|---|---|
| V8124 | 4.93 | 4.02 | 0.51 | 0.38 | 0.30 | 0.173 | Inventive |
| H12613 | 5.12 | 4.04 | 0.77 | 0.49 | 0.02 | 0.16 | Comparative |

The comparative alloy was taken from a standard Ti-54M sheet from a production heat (Heat number H12613), and the inventive alloy was from a laboratory heat (Heat number V8124). As shown, the inventive alloy contains about 0.30 wt % silicon.

Two sheets having two different grain sizes were produced using a laboratory forge press and rolling mill. The original billet material was forged to 2"×6" slab in beta processing. Then, the slab was forged to about 1.0" thick followed by a beta quench at 1066° C. (1950° F.). Two different rolling procedures were used to produce sheets having different grain size:

1). (Process A) Fine grain sheet was produced after heating at 718° C. (1325° F.) then rolled to 0.170" thick, then cross-rolled to 0.080" thick followed by a creep flatten at 732° C. (1350° F.).

2). (Process B) Regular grain sheet was produced after heating at 913° C. (1675° F.) then rolled to 0.170" thick then cross-rolled to 0.080" thick followed by a creep flatten at 871° C. (1600° F.).

Oxidation testing was carried out on a sheet processed by Process B, since oxidation is less sensitive to the grain size of materials. The condition of the oxidation was at 649° C. (1200° F.) and 760° C. (1400° F.) in a box furnace (in air) for up to 200 hrs. Sheet samples of production heat H12613 (Ti-54M) were included in the furnace to compare directly with the inventive alloy V8124.

The weight gain was measured and is shown below in Table 7:

TABLE 7

Weight Gain of Inventive and Comparative Alloys

| Heat | Temp ° C., (° F.) | Weight gain (mg/cm$^2$) 24 hr | 50 hr | 100 hr | 200 hr | Remarks |
|---|---|---|---|---|---|---|
| V8124 | 649° C. (1200° F.) | 0.42 | 0.47 | 0.69 | 0.96 | Inventive |
| | 760° C. (1400° F.) | 1.37 | 2.05 | 2.95 | 3.75 | |
| H12613 | 649° C. (1200° F.) | 0.65 | 0.99 | 1.67 | 2.79 | Comparative |
| | 760° C. (1400° F.) | 2.57 | 4.53 | 8.34 | 31.60 | |

TABLE 7-continued

| Weight Gain of Inventive and Comparative Alloys | | | | | | |
|---|---|---|---|---|---|---|
| | Temp ° C., | Weight gain (mg/cm$^2$) | | | | |
| Heat | (° F.) | 24 hr | 50 hr | 100 hr | 200 hr | Remarks |
| Ti-6Al-4V | 649° C. (1200° F.) | — | — | — | 2.24 | Comparative |
| | 760° C. (1400° F.) | — | — | — | 16.91 | |

These results indicate that the oxidation resistance of the inventive alloy, measured by weight gain, is significantly better than the comparative alloy.

Creep properties were also investigated for the comparative alloy (H12613) and the inventive alloy (V8124). In this testing, fine grain sheets produced with Process A and a grain size of approximately 2 μm were used, and the results are shown below in Table 8:

TABLE 8

| Summary of Creep Test for Inventive and Comparative Alloys 427° C. (800° F.) | | | | | | | | | | |
|---|---|---|---|---|---|---|---|---|---|---|
| | Stress | Time @ Creep Strain (hr) | | | | Creep Strain @ Time (%) | | | | |
| Heat | ksi | 0.1% | 0.2% | 0.5% | 1.0% | 25 hr | 35 hr | 50 hr | 100 hr | Remarks |
| H12613 | 20 | 1.21 | 4.98 | 52.6 | N/A | 0.394 | 0.441 | 0.491 | 0.609 | Comparative |
| V8124 | 20 | 64 | N/A | N/A | N/A | 0.077 | 0.083 | 0.092 | 0.108 | Inventive |
| Ti-64 (production) | 20 | 2.15 | 19 | 148 | N/A | 0.222 | 0.252 | 0.297 | 0.415 | Comparative |
| H12613 | 35 | 0.38 | 1.38 | 6.34 | 22.6 | 1.052 | 1.241 | 1.460 | 2.080 | Comparative |
| V8124 | 35 | 29.0 | N/A | N/A | N/A | 0.095 | 0.106 | 0.115 | 0.140 | Inventive |
| Ti-64 (production) | 35 | 1.05 | 13 | 120 | N/A | 0.254 | 0.292 | 0.340 | 0.459 | Comparative |

As clearly shown, the inventive alloy (V8124) displays a clear advantage in creep properties over the comparative alloy (H12613).

Figure 3:
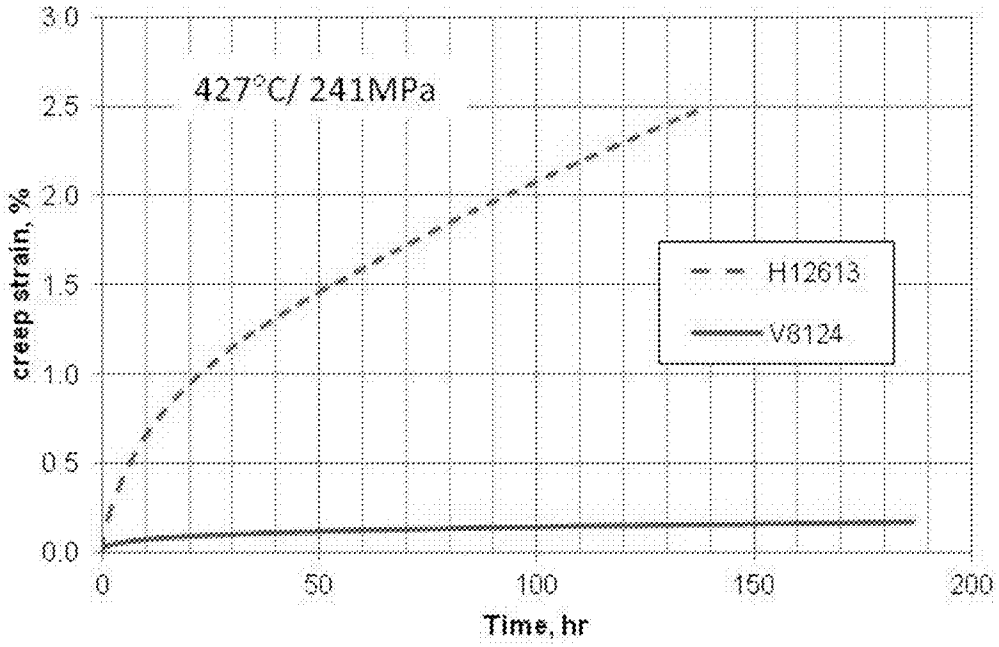
FIG. 3 is a graph illustrating creep properties of a comparative alloy versus an inventive alloy according to the teachings of the present disclosure.

Referring to FIG. 3, a graphical comparison of creep resistance between the inventive alloy and the comparative alloy is shown in more detail. The inventive alloy shows very small creep strain from the beginning of the creep test, i.e. primary creep, through the steady state creep regime as compared with the comparative alloy.

Elevated temperature tensile testing was also conducted using sub-size tensile test specimens with a gage length of 7.6 mm (0.30"). The intention of this test was to measure total elongation, which is one of the indicators of superplasticity, namely, higher elongation indicates better superplasticity. The results of this testing are shown below in Table 9:

TABLE 9

| Results of Elevated Temperature Tensile Testing | | | | | | |
|---|---|---|---|---|---|---|
| | Temperature | | UTS | | El | |
| | ° C. | ° F. | MPa | ksi | % | Remarks |
| V8124 | 649 | 1200 | 126 | 18.3 | 570 | Inventive |
| | 704 | 1300 | 53 | 7.7 | 1120 | |
| | 760 | 1400 | 28 | 4.1 | 1284 | |
| | 816 | 1500 | 16 | 2.3 | 1040 | |
| Ti-54M | 704 | 1300 | 48.3 | 7.0 | 899 | Comparative |
| | 760 | 1400 | 40.7 | 5.9 | 1281 | |
| | 816 | 1500 | 25.5 | 3.7 | 1442 | |
| | 871 | 1600 | 9.7 | 1.4 | 1084 | |

TABLE 9-continued

| Results of Elevated Temperature Tensile Testing | | | | | | |
|---|---|---|---|---|---|---|
| | Temperature | | UTS | | El | |
| | ° C. | ° F. | MPa | ksi | % | Remarks |
| Ti-6Al-4V | 760 | 1400 | 74.5 | 10.8 | 746 | Comparative |
| | 816 | 1500 | 42.7 | 6.2 | 852 | |
| | 871 | 1600 | 23.4 | 3.4 | 666 | |

As shown, the inventive alloy (V8124) shows more than 1200% of elongation at 760° C., which is considered sufficient for the application of superplastic forming. The peak elongation of the inventive alloy shows as good as Ti-54M and the elongation at 760° C. is equivalent. Also, the maximum elongation of the inventive alloy is greater than conventional alloy Ti-6Al-4V.

Accordingly, the teachings herein provide a high strength alpha-beta titanium alloy that has improved high temperature oxidation resistance, high temperature strength and creep resistance, and excellent superplasticity as compared with baseline alloys Ti-54M (Ti-5Al-4V-0.75Mo-0.5Fe) and Ti-6Al-4V.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide illustrations of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An alpha-beta titanium alloy comprising:

aluminum in an amount ranging between about 4.5 wt % to about 5.5 wt %;

vanadium in an amount ranging between about 3.0 wt % to about 5.0 wt %;

molybdenum in an amount ranging between about 0.72 wt % to about 1.8 wt %;

iron in an amount ranging between about 0.48 wt % to about 1.2 wt % iron;

oxygen in an amount ranging between about 0.12 wt % to about 0.25 wt %;

silicon in an amount ranging between about 0.10 wt % to about 0.40 wt %; and a balance titanium and incidental impurities, with each being less than about 0.1 wt % and in total less than about 0.5 wt %.

2. The alpha-beta titanium alloy according to claim 1, wherein the silicon is in an amount ranging between about 0.15wt % to about 0.40 wt %.

3. The alpha-beta titanium alloy according to claim 1, wherein the silicon is in an amount ranging between about 0.25 wt % to about 0.35 wt %.

4. The alpha-beta titanium alloy according to claim 1 further comprising optional alloying elements selected from the group consisting of niobium, chromium, tin, and zirconium, wherein a total of the optional alloying elements less than about 1.0 wt %.

5. A component comprising an alloy according to claim 1.

6. An alpha-beta titanium alloy consisting essentially of:

aluminum in an amount ranging between about 4.5 wt % to about 5.5 wt %;

vanadium in an amount ranging between about 3.0 wt % to about 5.0 wt %;

molybdenum in an amount ranging between about 0.72 wt % to about 1.8 wt %;

iron in an amount ranging between about 0.48 wt % to about 1.2 wt % iron;

oxygen in an amount ranging between about 0.12 wt % to about 0.25 wt %;

silicon in an amount ranging between about 0.10 wt % to about 0.40 wt %; and a balance titanium and incidental impurities, with each being less than about 0.1 wt % and in total less than about 0.5 wt %.

7. The alpha-beta titanium alloy according to claim 6, wherein the silicon is in an amount ranging between about 0.15 wt % to about 0.40 wt %.

8. The alpha-beta titanium alloy according to claim 6, wherein the silicon is in an amount ranging between about 0.25 wt % to about 0.35 wt %.

9. A component comprising an alloy according to claim 6.

10. A high strength alpha-beta titanium alloy having superplasticity at temperatures below about 815° C. (1,500° F.) and having:

molybdenum in an amount ranging between about 0.72 wt % to about 1.8 wt %;

iron in an amount ranging between about 0.48 wt % to about 1.2 wt % iron; and silicon in an amount ranging between about 0.10 wt % to about 0.40 wt %.

11. The high strength alpha-beta titanium alloy according to claim 10, wherein the superplasticity results in greater than about 1000% elongation.

12. The high strength alpha-beta titanium alloy according to claim 10, wherein the alloy has less than about 1mg/cm$^2$ weight gain at 649° C. (1,200° F.) up to about 200 hours.

13. The high strength alpha-beta titanium alloy according to claim 10, wherein the alloy has less than about 4.0 mg/cm$^2$ weight gain at 760° C. (1,400° F.) up to about 200 hours.

14. The high strength alpha-beta titanium alloy according to claim 10, wherein the silicon is in an amount ranging between about 0.15 wt % to about 0.40 wt %.

15. The high strength alpha-beta titanium alloy according to claim 10, wherein the silicon is in an amount ranging between about 0.25 wt % to about 0.35 wt %.

16. The high strength alpha-beta titanium alloy according to claim 10, wherein a creep strain of the alloy is less than about 0.15 over 100 hours at 427° C. (800° F.) and 35 ksi.

17. A component comprising an alloy according to claim 10.

18. The high strength alpha-beta titanium alloy according to claim 10 comprising vanadium in an amount less than about 5.0 wt %.

19. The high strength alpha-beta titanium alloy according to claim 10, wherein a density of the alloy is less than about 4.60 g/cm$^3$.

20. The alpha-beta titanium alloy according to claim 1, wherein:

the aluminum is about 5.0 wt %;

the vanadium is about 4.0 wt;

the molybdenum is about 0.75 wt %;

the iron is about 0.50 wt % iron;

the oxygen is about 0.17 wt %; and the silicon is about 0.3 wt %.

21. An alpha-beta titanium alloy comprising:

aluminum in an amount ranging between about 4.5 wt % to about 5.5 wt %;

vanadium in an amount ranging between about 3.0 wt % to about 5.0 wt %;

molybdenum in an amount ranging between about 0.6 wt % to about 1.8 wt %;

iron in an amount ranging between about 0.4 wt % to about 1.2 wt % iron;

oxygen in an amount ranging between about 0.12 wt % to about 0.25 wt %;

silicon in an amount ranging between about 0.10 wt % to about 0.40 wt %; and a balance titanium and incidental impurities, with each being less than about 0.1 wt %, respectively, and in total less than about 0.5 wt %.

* * * * *